United States Patent [19]

Sbrana

[11] Patent Number: 4,896,521

[45] Date of Patent: Jan. 30, 1990

[54] PROCESS FOR MANUFACTURING A TUBULAR SEMIFINISHED COPPER ALLOY PART

[75] Inventor: Armando Sbrana, Tirrenia, Italy

[73] Assignee: Europa Metalli-LMI S.P.A., Firenze Borgo Pinti, Italy

[21] Appl. No.: 252,854

[22] Filed: Oct. 3, 1988

[30] Foreign Application Priority Data

Oct. 1, 1987 [IT] Italy ..... 67836 A/87

[51] Int. Cl.[4] ..... B21C 35/04

[52] U.S. Cl. ..... 72/255

[58] Field of Search ..... 72/254, 255

[56] References Cited

U.S. PATENT DOCUMENTS

| | | | |
|---|---|---|---|
| 590,130 | 9/1897 | Bungeroth | 72/255 |
| 2,679,931 | 6/1954 | Cigliano | 72/255 |
| 3,080,650 | 3/1963 | Jury | 72/255 |
| 3,793,870 | 2/1974 | Allen | 72/255 |

FOREIGN PATENT DOCUMENTS

| | | | |
|---|---|---|---|
| 1314343 | 4/1973 | United Kingdom | 72/254 |

*Primary Examiner*—Lowell A. Larson

*Attorney, Agent, or Firm*—Pearne, Gordon, McCoy & Granger

[57] ABSTRACT

A process comprising at least a first stage wherein a copper alloy ingot is placed against the end wall of a cavity in a mold, and at least a second stage wherein a pressure member, designed to move along the longitudinal axis of the cavity, exerts sufficient pressure on the ingot to permanently deform and spread the material of the same inside the cavity in the opposite direction to the aforementioned pressure member, so as to form an intermediate semifinished part having a side wall and an end wall which is subsequently cut off.

5 Claims, 3 Drawing Sheets

PROCESS FOR MANUFACTURING A TUBULAR SEMIFINISHED COPPER ALLOY PART

BACKGROUND OF THE INVENTION

The present invention relates to a process for manufacturing a tubular, semifinished copper alloy part, particularly suitable for producing ingot molds for the continuous casting of steel. Ingot molds of the aforementioned type are employed for feeding molten steel from the smelting furnace to manufacturing machinery. They are tubular in shape, and may be straight or curved, with any internal cross section. This is usually square or rectangular, and may vary gradually in size along the mold axis.

Ingot molds of the aforementioned type are usually formed from tubular semifinished copper alloy parts formed by means of extrusion or drawing. The semifinished parts so formed are subjected to further processing, usually involving permanent deformation of the same, for achieving an inner surface finish and mechanical strength as required by the finished mold.

The process according to the present invention is particularly suitable for producing semifinished parts for the manufacture of ingot molds of the aforementioned type.

A major drawback of known extrusion and drawing processes, for producing said tubular semifinished parts, is that they involve numerous processing stages, each of which provides for only slightly modifying the shape and size of the part formed in the previous stage. Also, such processes require the use of extremely powerful presses.

SUMMARY OF THE INVENTION

The aim of the present invention is to provide a process for the manufacture of tubular semifinished parts of the aforementioned type, involving a limited number of processing stages, which may be performed easily on straightforward manufacturing facilities, in particular, on small-size presses of roughly a quarter of the capacity required for producing semifinished parts of the same size using the aforementioned standard processes.

With this aim in view, according to the present invention, there is provided a process for manufacturing a tubular, semifinished copper alloy part, particularly suitable for producing ingot molds for the continuous casting of steel, characterized by the fact that it comprises at least a first stage wherein an ingot of said alloy is placed against the end wall of a cavity in a mold, the lateral surface of said cavity being substantially the same as that of said semifinished part, and said ingot presenting a lateral surface matching a portion of said lateral surface of said cavity, and a height equal to a fraction of the height of said lateral surface; and at least a second stage wherein a pressure member, designed to move along the longitudinal axis of said cavity and having a lateral surface substantially identical to the inner surface of said semifinished part, exerts sufficient pressure on said ingot to permanently deform and spread the material of the same inside said cavity and in the opposite direction to movement of said pressure member, so as to form an intermediate semifinished part having a lateral wall whose outer and inner surfaces respectively match the inner surface of said cavity and the outer surface of said pressure member, and an end wall joined to said lateral surface; a third stage for removing said end wall of said mold cavity and replacing the same with an annular cutting die having an inner surface substantially matching the outer surface of said pressure member; said cutting die acting as a support for the end of said semifinished part; a fourth stage wherein said pressure member exerts sufficient pressure on said end wall of said semifinished part to sever said end wall on said intermediate semifinished part from the lateral wall of the same, and so form said tubular semifinished part; and in said first and second stages, said end wall of said mold cavity is formed via closing means held against one end of said cavity for the purpose of closing the same; said closing means comprising a cup-shaped body having a lateral wall and end wall, and a plug designed to fit inside said cup-shaped body; said lateral wall of said cup-shaped body constituting said cutting die, and said lateral wall of said cup-shaped body and said plug defining the end surface of said mold cavity; said closing means being removed from said mold in said third stage, for removing said plug from said cup-shaped body, which is fitted back on to said mold for forming said cutting die.

BRIEF DESCRIPTION OF THE DRAWINGS

The basic stages in the process according to the present invention will be described by way of examples with reference to the accompanying drawings, in which.

DETAILED DESCRIPTION OF THE INVENTION

The process according to the present invention provides for producing a tubular semifinished copper alloy part, particularly for the manufacture of ingot molds. Said semifinished part, of the type indicated by number 1 in the last stage of the process in FIG. 6, may be of any section or thickness, but is preferably square or rectangular in cross-section.

Figure 1:
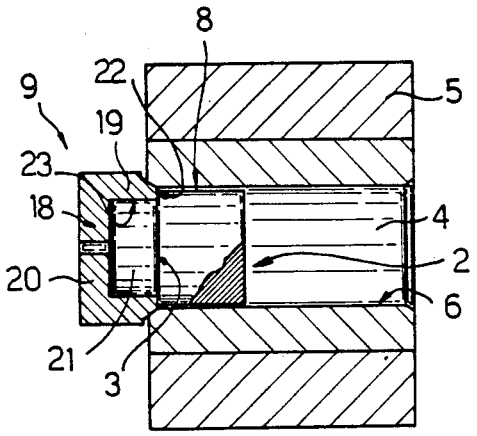
FIGS. 1 to 6 show the six basic stages in the process according to the present invention.

The first stage in the process, as shown in FIG. 1, substantially consists in placing a copper alloy ingot 2 against the end wall 3 of a cavity 4 in a mold 5. The lateral surface 6 of said cavity is substantially the same as the lateral surface 7 (FIG. 6) of semifinished part 1, whereas ingot 2, as shown clearly in FIG. 1, presents a lateral surface 8 matching a portion of lateral surface 6 of said cavity, and is equal in height to a fraction of the same. In the first stage of the process, end wall 3 defining cavity 4 may be formed in any manner, e.g. by means of a plate on mold 5. According to the present invention, however, said end wall is conveniently formed using closing means indicated as a whole by 9 and described in detail later on.

Figure 2:
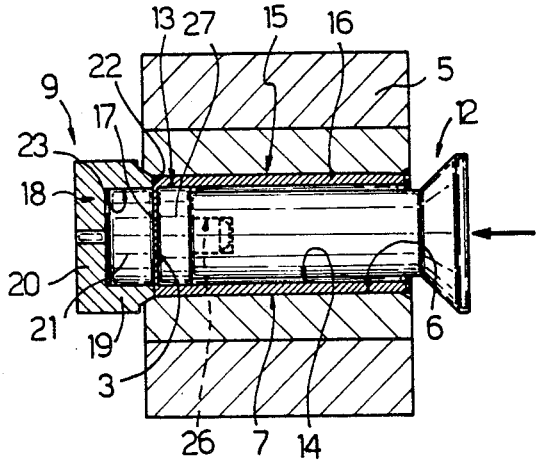

In the second stage of the process shown in FIG. 2, a pressure member 12, designed to move along the longitudinal axis of cavity 4, exerts sufficient pressure on ingot 2 to permanently deform and spread the material of the same inside cavity 4 and in the opposite direction to movement of pressure member 12.

Lateral surface 13 on the end of pressure member 12 is substantially the same as the inner surface 14 (FIG. 6) of tubular semifinished part 1. In FIG. 2, pressure member 12 is shown in the end-stroke position at the end of the second stage in the process.

In the second stage, mold 5 is conveniently placed against or secured to the plate of a suitable fixture, whereas pressure member 12 is connected to the movable plate of a press, e.g. a hydraulic press.

Figure 6:
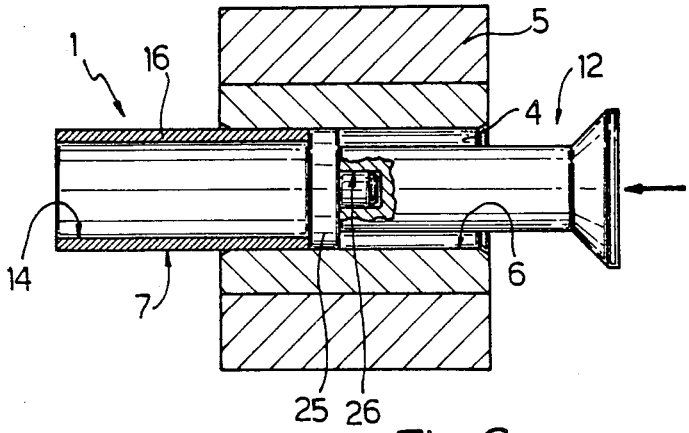

As shown clearly in FIG. 2, at the end of stage two, there is formed an intermediate semifinished part 15 having a lateral wall 16 whose outer and inner surfaces respectively match inner surface 6 of cavity 4 and outer surface 13 of pressure member 12, and an end wall 17 of appropriate thickness, joined to said lateral wall 16. Ingot 2 is sized so that its volume equals that of required intermediate semifinished part 15, the lateral wall 16 of which, in turn, presents the same length as required semifinished part 1 (FIG. 6). Said closing means 9 conveniently comprise a cup-shaped body 18 having a lateral wall 19 and end wall 20, and a plug 21 designed to fit inside cup-shaped body 18. As shown clearly in FIGS. 1 and 2, plug 21 is sized so that, when fitted inside cup-shaped body 18, it rests flush with the top surface 22 of lateral wall 19, thus forming end wall 3 of cavity 4. Also, the shape and size of inner surface 23 of lateral wall 19 match those of inner surface 14 of semifinished part 1.

Figure 3:
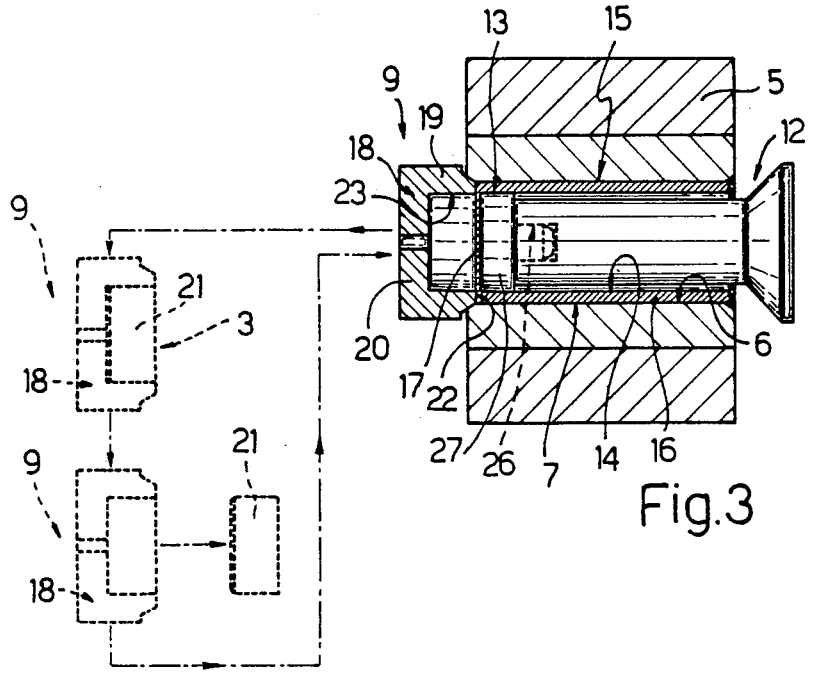

In the third stage of the process shown in FIG. 3, end wall 3 of cavity 4 is taken off the mold by removing closing means 9. Plug 21 is then removed from cup-shaped body 18, which is then fitted back on to mold 5 as shown in FIG. 3. This therefore provides not only for removing end wall 3 of cavity 4, but also for replacing it with a cutting die substantially formed by lateral wall 19 of cup-shaped body 18. By virtue of the aforementioned size of inner surface 23 of lateral wall 19, top surface 22 of wall 19 acts as a support for the end of intermediate semifinished part 15, as shown in FIG. 3.

Figure 4:
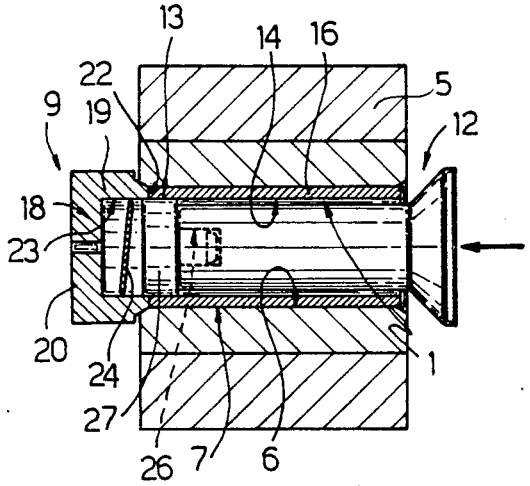

In the fourth stage of the process (FIG. 4), pressure member 12 exerts sufficient pressure on end wall 17 of intermediate semifinished part 15 to sever end wall 17 from lateral wall 16 and so form semifinished part 1. For so doing (FIG. 4), the end of pressure member 12 is inserted inside cup-shaped body 18, so as to unload inside the same a disk 24 consisting of end wall 17 severed off intermediate semifinished part 15.

Figure 5:
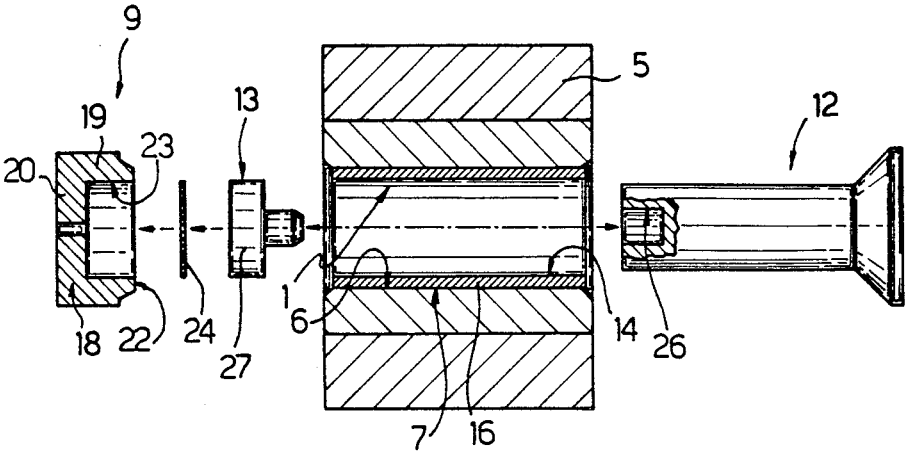

In the fifth stage of the process (FIG. 5), pressure member 12 is withdrawn from semifinished part 1, and cup-shaped body 18 is removed from mold 5 so as to free both ends of cavity 4 as shown in FIG. 5.

In the sixth stage of the process (FIG. 6), pressure member 12 exerts sufficient pressure on the end of semifinished part 1 opposite the end contacting cup-shaped body 18 in stage five, to force part 1 axially from cavity 4 on the side from which cup-shaped body 18 was removed. For so doing, in stage six, pressure member 12 is fitted with a head 25 having substantially the same diameter as cavity 4.

Pressure member 12 conveniently presents connecting means consisting, for example, of a dead hole 26 for connecting said head 25 employed in the sixth stage of the process, and a further head 27 having a lateral surface 13 smaller in diameter than head 25, and which is used in the second and fourth stages of the process. Before being inserted inside cavity 4 of mold 5 in the first stage of the process, ingot 2 is conveniently heated to a predetermined temperature, for enabling smooth flow of the ingot material inside cavity 4, in the opposite direction to pressure member 12, in the second stage of the process. Said temperature conveniently ranges between 850° and 950° C.

The process according to the present invention has been found to produce tubular semifinished parts 1 of substantially consistent size for all types of cross section, and a good surface finish. Furthermore, all stages in the process may be performed on a small-size press, regardless of the size of semifinished part 1. This favourable result is achieved by virtue of the second stage in the process (FIG. 2) wherein the ingot material is spread inside cavity 4 in the opposite direction to movement of pressure member 12, despite only modest pressure being exerted on ingot 2. Furthermore, semifinished part 1 is produced using straightforward equipment from which it need never be removed at any time during the overall process, the only parts requiring removal being closing means 9, which are removed quickly and easily in the third and fifth stages of the process. To those skilled in the art it will be clear that changes may be made to the various stages in the process as described and illustrated herein without, however, departing from the scope of the present invention.

I claim:

1. A process for manufacturing a tubular, semifinished copper alloy part, particularly suitable for producing ingot molds for the continuous casting of steel, characterized by the fact that it comprises at least a first stage wherein an ingot of said alloy is placed against the end wall of a cavity in a mold, the lateral surface of said cavity being substantially the same as that of said semifinished part, and said ingot presenting a lateral surface matching a portion of said lateral surface of said cavity, and a height equal to a fraction of the height of said lateral surface; and at least a second stage wherein a pressure member, designed to move along the longitudinal axis of said cavity and having a lateral surface substantially identical to the inner surface of said semifinished part, exerts sufficient pressure on said ingot to permanently deform and spread the material of the same inside said cavity and in the opposite direction to movement of said pressure member, so as to form an intermediate semifinished part having a lateral wall whose outer and inner surfaces respectively match the inner surface of said cavity and the outer surface of said pressure member, and an end wall joined to said lateral surface; a third stage for removing said end wall of said mold cavity and replacing the same with an annular cutting die having an inner surface substantially matching the outer surface of said pressure member; said cutting die acting as a support for the end of said semifinished part; a fourth stage wherein said pressure member exerts sufficient pressure on said end wall of said semifinished part to sever said end wall on said intermediate semifinished part from the lateral wall of the same, and so form said tubular semifinished part; and in said first and second stages, said end wall of said mold cavity if formed via closing means held against one end of said cavity for the purpose of closing the same; said closing means comprising a cup-shaping body having a lateral wall and end wall, and a plug designed to fit inside said cup-shaped body; said lateral wall of said cup-shaped body constituting said cutting die, and said lateral wall of said cup-shaped body and said plug defining the end surface of said mold cavity; said closing means being removed from said mold in said third stage, for removing said plug from said cup-shaped body, which is fitted back on to said mold for forming said cutting die.

2. A process as claimed in claim 1, characterized by the fact that it comprises a fifth stage for withdrawing said pressure member from said mold cavity, and removing said cutting die from said mold; and a sixth stage wherein said pressure member exerts sufficient pressure on the end of said tubular semifinished part, opposite the end contacting said cutting die, to axially force said tubular semifinished part out of said cavity on the side from which said cutting die was removed; said pressure member presenting, in said sixth stage, a head having substantially the same outside diameter as said cavity.

3. A process as claimed in claim 2, characterized by the fact that said pressure member is fitted, in said sixth stage, with a second head having substantially the same outside diameter as said tubular semifinished part.

4. A process as claimed in claim 1, characterized by the fact that said pressure member is fitted, in said second stage, with a first head having an outside diameter substantially equal to the inside diameter of said tubular semifinished part.

5. A process as claimed in claim 1, characterised by the fact that, in said first stage, said ingot is heated to a predetermined temperature before being inserted inside said mold cavity.

* * * * *